US010087627B2

(12) United States Patent
Booij et al.

(10) Patent No.: US 10,087,627 B2
(45) Date of Patent: Oct. 2, 2018

(54) LIGHT-EMITTING ACOUSTIC PANEL WITH DUCT

(71) Applicant: PHILIPS LIGHTING HOLDING B.V., Eindhoven (NL)

(72) Inventors: Silvia Maria Booij, Eindhoven (NL); Ronald Cornelis De Gier, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 200 days.

(21) Appl. No.: 14/893,088

(22) PCT Filed: May 20, 2014

(86) PCT No.: PCT/EP2014/060272
§ 371 (c)(1),
(2) Date: Nov. 23, 2015

(87) PCT Pub. No.: WO2014/187788
PCT Pub. Date: Nov. 27, 2014

(65) Prior Publication Data

US 2016/0123005 A1 May 5, 2016

(30) Foreign Application Priority Data

May 23, 2013 (EP) ..... 13168837

(51) Int. Cl.
*E04B 9/32* (2006.01)
*E04B 9/00* (2006.01)
(Continued)

(52) U.S. Cl.
CPC ..... *E04B 9/32* (2013.01); *A62C 35/68* (2013.01); *E04B 9/001* (2013.01); *E04B 9/04* (2013.01);
(Continued)

(58) Field of Classification Search
CPC ..... F21V 33/0088; F21V 7/0041; F21V 2103/10; F21V 7/0008; F21V 7/06;
(Continued)

(56) References Cited

U.S. PATENT DOCUMENTS 1,726,501 A 8/1929 Norris
2,218,992 A * 10/1940 Munroe ..... E04B 9/32 181/289
(Continued)

FOREIGN PATENT DOCUMENTS

CN 101178514 A 5/2008
CN 103669625 A 3/2014
(Continued)

*Primary Examiner* — Jong-Suk (James) Lee
*Assistant Examiner* — Mark Tsidulko
(74) *Attorney, Agent, or Firm* — Akarsh P. Belagodu

(57) ABSTRACT

There is provided a light-emitting acoustic panel that may be mounted in a ceiling. The light-emitting acoustic panel comprises a sound-absorbing layer and a light-transmissive layer arranged in parallel such that a space is formed in-between. In the space a light source and a reflector are arranged such that light emitted by the light source is redirected by the reflector and emitted towards a reflective side of the sound-absorbing layer. There is further a duct arranged through the light-emitting acoustic panel. In the duct, devices providing functionalities such as sensing, sound, lighting may be arranged. The outer surface of the duct, facing the space between the sound-absorbing layer and the light-transmissive layer comprises a specularly reflective surface.

11 Claims, 2 Drawing Sheets

(51) Int. Cl.

| | |
|---|---|
| ***E04B 9/04*** | (2006.01) |
| ***F21V 33/00*** | (2006.01) |
| ***F21S 8/04*** | (2006.01) |
| ***F21V 7/00*** | (2006.01) |
| ***F21V 7/06*** | (2006.01) |
| ***F21V 17/10*** | (2006.01) |
| ***F21V 23/04*** | (2006.01) |
| ***F21S 4/28*** | (2016.01) |
| ***A62C 35/68*** | (2006.01) |
| ***F21S 8/02*** | (2006.01) |
| ***F21V 5/00*** | (2018.01) |
| *F21Y 105/00* | (2016.01) |
| *F21Y 103/10* | (2016.01) |
| *F21Y 115/10* | (2016.01) |

(52) U.S. Cl.
CPC ..... *E04B 9/0428* (2013.01); *F21S 4/28* (2016.01); *F21S 8/026* (2013.01); *F21S 8/04* (2013.01); *F21V 5/002* (2013.01); *F21V 7/0008* (2013.01); *F21V 7/0041* (2013.01); *F21V 7/06* (2013.01); *F21V 17/10* (2013.01); *F21V 23/0442* (2013.01); *F21V 33/0088* (2013.01); *F21Y 2103/10* (2016.08); *F21Y 2105/00* (2013.01); *F21Y 2115/10* (2016.08)

(58) Field of Classification Search
CPC ..... F21V 17/10; F21V 23/0442; F21V 5/002; F21Y 2105/00; F21S 8/026
USPC ..... 362/235, 147–149, 297
See application file for complete search history.

(56) References Cited

U.S. PATENT DOCUMENTS

| | | | | |
|---|---|---|---|---|
| 3,460,299 | A * | 8/1969 | Wilson | E04B 9/303 181/286 |
| 5,279,632 | A | 1/1994 | Decker et al. | |
| 5,433,787 | A * | 7/1995 | Suzuki | C23C 16/455 118/719 |
| 6,179,451 | B1 * | 1/2001 | Bodine | E04B 9/001 362/147 |
| 6,474,845 | B1 * | 11/2002 | Mabe | F21S 48/1394 362/296.04 |
| 7,303,305 | B2 * | 12/2007 | Kennedy | E04B 9/0435 362/147 |
| 7,571,790 | B2 | 8/2009 | Kim | |
| 8,794,809 | B2 * | 8/2014 | Lundin | G02B 6/0006 362/551 |
| 8,931,920 | B2 * | 1/2015 | Tessnow | F21V 7/0083 362/235 |
| 8,955,998 | B2 * | 2/2015 | Wong | F21S 8/046 362/147 |
| 8,967,823 | B2 * | 3/2015 | D'Antonio | E04B 9/32 362/147 |
| 2007/0220824 | A1 | 9/2007 | Hasegawa et al. | |
| 2008/0259616 | A1 * | 10/2008 | Morgan | E04B 9/001 362/404 |
| 2009/0126287 | A1 | 5/2009 | Meres | |

FOREIGN PATENT DOCUMENTS

| | | | |
|---|---|---|---|
| DE | 202010003089 | U1 | 7/2010 |
| EP | 2573461 | A1 | 3/2013 |
| WO | 2008052213 | A2 | 5/2008 |
| WO | WO2013153491 | A1 | 10/2013 |

* cited by examiner

LIGHT-EMITTING ACOUSTIC PANEL WITH DUCT

CROSS-REFERENCE TO PRIOR APPLICATIONS

This application is the U.S. National Phase application under 35 U.S.C. § 371 of International Application No. PCT/EP2014/060272, filed on May 20, 2014, which claims the benefit of European Patent Application No. 13168837.6, filed on May 23, 2013. These applications are hereby incorporated by reference herein.

FIELD OF THE INVENTION

The present invention relates to a light-emitting acoustic panel and to a method of manufacturing a light-emitting acoustic panel.

BACKGROUND OF THE INVENTION

In modern buildings, the building elements used, for example in the ceiling, need to be compatible with various functions in relation to, for example, acoustics, lighting, ventilation, sensing, etc.

An example of such a building element may be a ceiling panel with certain desired properties such as acoustic and visual properties. For example, US-2009/0126287 discloses an acoustic panel with a recess for enabling mounting of additional devices in the acoustic panel. Such an acoustic panel should provide sound damping but also allow for auxiliary functionalities such as e.g. lighting, sound, or sensing. To provide such functionalities, lighting fixtures, speakers, sensors etc may be provided in recesses arranged in the acoustic panel.

It would be desirable to provide an acoustic panel that provides for more uniform lighting while at the same time allowing for auxiliary functions, such as the above-mentioned sound, sensing or sprinklers etc.

SUMMARY OF THE INVENTION

In view of the above-mentioned and other drawbacks of the prior art, a general object of the present invention is to provide a light-emitting acoustic panel that enables the provision of auxiliary functionalities while providing more uniform lighting.

According to a first aspect of the present invention there is provided a light-emitting acoustic panel, comprising: a light source; a sound-absorbing layer having an optically reflective side facing the light source; a light-transmissive layer arranged in parallel with and spaced apart from the sound-absorbing layer, such that the light source is arranged in a space between the sound-absorbing layer and the light-transmissive layer; and a duct through the light-emitting acoustic panel, wherein a surface of the duct facing the space between the sound-absorbing layer and the light-transmissive layer is a specularly reflective surface.

A light source may comprise one or several lighting units. A lighting unit comprised in the light source may advantageously be a solid state lighting unit, in which light is generated through recombination of electrons and holes. Examples of solid state light sources include LEDs and semiconductor lasers.

The sound-absorbing layer may advantageously be made of a material capable of absorbing sound waves, such as a porous material. One example of such a porous material is glass wool.

Furthermore, the sound-absorbing layer may advantageously be provided as a substantially sheet-shaped sound-absorbing layer.

The specularly reflective surface of the duct facing the space between the sound-absorbing layer and the light-transmissive layer may advantageously have an optical reflectance that is higher than 50%.

According to various embodiments of the present invention there may be one or several ducts arranged in the light-emitting acoustic panel.

The present invention is based on the realization that a light-emitting acoustic panel providing uniform light may be achieved through a configuration with a sound-absorbing layer and a light-transmissive layer separated by an intermediate space. The surface of the sound-absorbing layer facing the light-transmissive layer is specularly reflective and the intermediate space acts as a mixing chamber for light reflected by the sound-absorbing layer. Hereby, uniform light across substantially the entire surface of the light-emitting acoustic panel can be achieved, and the acoustic performance is improved. Through such a configuration, one or several ducts can be arranged almost anywhere in the light-emitting acoustic panel, allowing for auxiliary functionalities, such as sensors, ventilation, sprinklers etc. Additionally, the present inventors have realized that one or several such ducts may be provided substantially without introducing any unwanted optical phenomena, such as shadowing, by providing the duct(s) with an optically reflective outer surface.

Because the surface of the duct facing the space between the sound-absorbing layer and the light-transmissive layer is specularly reflective, efficient utilization of the light emitted by the at least one light source comprised in the light-emitting acoustic panel is provided.

Moreover, the duct may advantageously extend through the sound-absorbing layer and the light-transmissive layer perpendicular to the sound-absorbing layer. This may simplify alignment of the duct with a device providing functionality so that mounting the light-emitting acoustic panel on a site is facilitated. However, in various embodiments, the duct may advantageously be configured differently. For instance, the duct may be angled and/or tapered. In the case of a tapered duct, there may be a first opening in the light-emitting face of the light-emitting acoustic panel and a second opening in the opposite face (on the sound-absorbing layer side), where the second opening is larger than the first opening. This may facilitate mounting of the light-emitting acoustic panel.

According to various embodiments of the present invention, the light-emitting acoustic panel may further comprise a reflector arranged to receive light from the light source and to redirect the received light towards the optically reflective side of the sound-absorbing layer. Hereby, light emitted by the light source is primarily directed towards the sound-absorbing layer and not directly towards the light-transmissive layer, which provides for improved uniformity of the light emitted by the light-emitting acoustic panel, as well as for reduced glare.

The above-mentioned reflector may advantageously be configured such that a cross-section of the reflector in a plane perpendicular to the sound-absorbing layer comprises a parabolic line segment. Such a reflector shape may provide for efficient and uniform redirection of light emitted by the light source towards the reflective surface of the sound-absorbing layer. This is particularly the case if the light source is arranged offset from the focal point/line of the parabolic reflector.

According to various embodiments of the present invention, the light source may, furthermore, be an elongated light source, which may be arranged along a line that is parallel to an edge of the light-emitting acoustic panel. Such an elongated light source may be arranged adjacent to an edge of the light-emitting acoustic panel and/or "inside" the light-emitting acoustic panel. In the latter case, the light-emitting acoustic panel may advantageously comprise an elongated reflector arrangement being configured to reflect light from the elongated light source in two directions generally in parallel to the sound-absorbing layer.

Through the provision of one or several elongated light sources in combination with suitable reflector(s), uniform emission of light is provided for, while at the same time enabling the formation of ducts at various locations in the light-emitting acoustic panel as most of the area of the light-emitting acoustic panel can then be free from light sources and sensitive wiring etc.

Moreover, the light source may comprise a plurality of lighting units, such as LED-modules, arranged along at least one edge portion of the light-emitting panel.

The duct may advantageously be cylindrical. However, the duct may have other shapes, such as having a rectangular, or any other polygonal cross-section. The duct may furthermore have a non-polygonal cross-section that is not circular, such as an elliptical cross-section.

According to various embodiments of the present invention, the light-transmissive layer may be an optically diffusive layer, whereby improved uniformity of the emitted light can be achieved.

Moreover, the light-transmissive layer may advantageously be air permeable to allow acoustic pressure waves impinging on the light-transmissive layer to reach the sound absorbing layer. For example, the light-transmissive layer may advantageously be made of textile or paper.

Alternatively or in combination, the light-transmissive layer may be flexible to allow transmission of pressure waves substantially without air passing through the light-transmissive layer.

Moreover, according to various embodiments the light-emitting acoustic panel may be configured for mounting in a ceiling. To that end, the light-emitting acoustic panel may further comprise a structure for allowing attachment of the light-emitting acoustic panel to the ceiling with the light-transmissive layer of the light-emitting acoustic panel facing away from the ceiling.

According to a second aspect of the present invention there is provided a method of manufacturing a light-emitting acoustic panel according to the first aspect, wherein the method comprises the steps of: providing a light-emitting acoustic panel comprising: a light source; a sound-absorbing layer having an optically reflective side facing the light source; and a light-transmissive layer arranged in parallel with and spaced apart from the sound-absorbing layer, such that the light source is arranged in a space between the sound-absorbing layer and the light-transmissive layer; forming a hole through the light-emitting acoustic panel; providing a duct having a specularly reflective outer surface; and inserting the duct in the hole through the light-emitting acoustic panel.

In summary, there is thus provided a light-emitting acoustic panel that may be mounted in a ceiling. The light-emitting acoustic panel comprises a sound-absorbing layer and a light-transmissive layer arranged in parallel such that a space is formed in-between. In the space a light source and a reflector are arranged such that light emitted by the light source is redirected by the reflector and emitted towards a reflective side of the sound-absorbing layer. There is further a duct arranged through the light-emitting acoustic panel. In the duct, devices providing functionalities such as sensing, sound, lighting may be arranged. The outer surface of the duct, facing the space between the sound-absorbing layer and the light-transmissive layer comprises a reflective surface.

BRIEF DESCRIPTION OF THE DRAWINGS

These and other aspects of the present invention will now be described in more detail, with reference to the appended drawings showing an exemplary embodiment of the invention, wherein.

DETAILED DESCRIPTION OF THE EMBODIMENTS

In the following description, the present invention is mainly described with reference to an acoustic ceiling panel with integrated LED strips arranged along the edges of the panel and reflectors directing light from the LEDs towards a reflective side of the sound-absorbing layer.

It should, however, be noted that this by no means limits the scope of the invention, which is equally applicable to other applications, such as light-emitting wall panels etc. Furthermore, the light source may be any other light source such as another semiconductor light source or a fluorescent light source.

Figure 1:
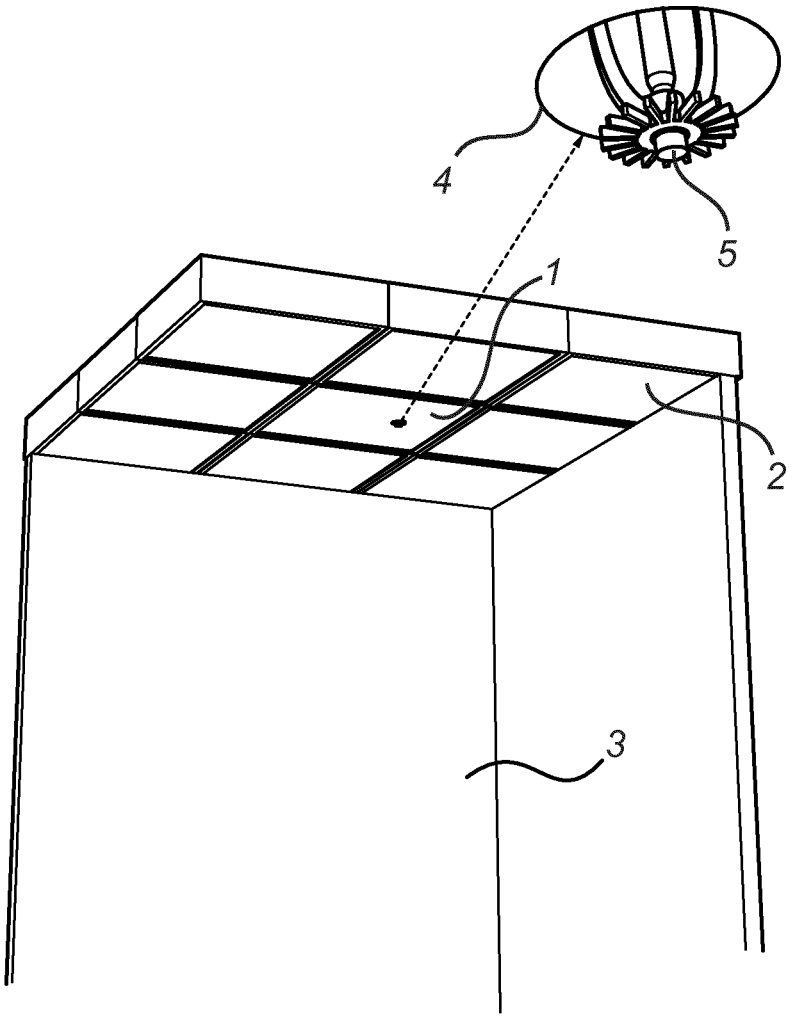
FIG. 1 schematically shows an exemplary application for an embodiment of the light-emitting acoustic panel according to the present invention.

FIG. 1 schematically illustrates an exemplary application for embodiments of the light-emitting acoustic panel 1 according to the present invention, arranged in a ceiling among other, conventional, ceiling panels 2 in a room 3. In the light-emitting acoustic panel 1 there is a duct 4 arranged through the panel 1. Inside the duct, there is a sprinkler 5. The duct 4 in the light-emitting acoustic panel 1 is arranged such that the duct is aligned with the sprinkler when the light-emitting acoustic panel 1 is mounted in the ceiling. The configuration of the light-emitting acoustic panel 1 will now be described with reference to FIG. 2.

Figure 2:
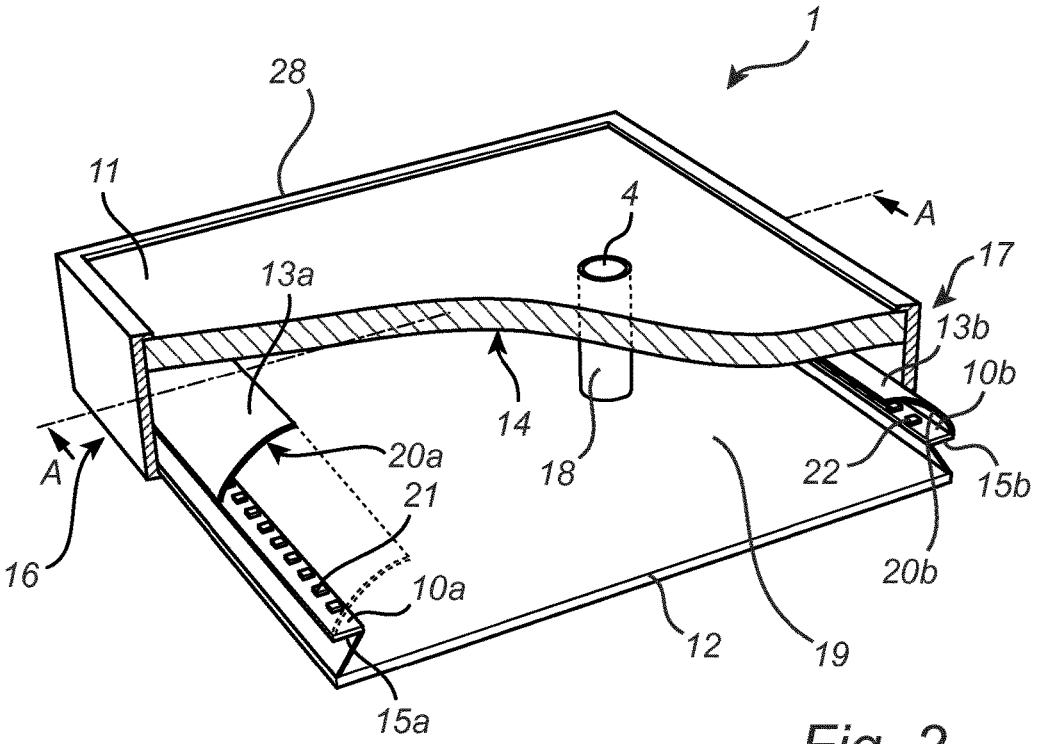
FIG. 2 is a schematic perspective and partly cut-out view of the light-emitting acoustic panel in FIG. 1.

Referring to FIG. 2, the light-emitting acoustic panel 1 comprises a first 10*a* and a second light source 10*b*, a first 13*a* and a second reflector 13*b*, a sound-absorbing layer 11, a light-transmissive layer 12, and a duct 4.

The sound-absorbing layer 11 and the light-transmissive layer 12 are arranged in parallel such that an intermediate space 19 is formed between the sound-absorbing layer 11 and the light-transmissive layer 12. The light sources 10*a-b* and the reflectors 13*a-b* are arranged in the intermediate space 19.

The sound-absorbing layer 11, which may advantageously be formed from a sound-absorbing material such as glass wool, has an optically reflective side 14 facing the light sources 10. The duct 4 is arranged through the sound-absorbing layer 11 and the light-transmissive layer 12. In this embodiment, the duct 4 is arranged perpendicular to both the sound-absorbing layer 11 and the light-transmissive layer 12. The duct comprises an optically reflective surface 18 on the side of the duct 4 that faces the space 19 between the sound-absorbing layer 11 and the light-transmissive layer 12.

In the presently illustrated example embodiment, each of the light sources 10*a-b* is an elongated light source. The first light source 10*a* comprises a plurality of light-emitting diodes (LEDs) 21 (only one of these is indicated by a reference numeral to avoid cluttering the drawing) arranged on a carrier 15*a*. Analogously, the second light source 10*b* comprises a plurality of light-emitting diodes (LEDs) 22 (only one of these is indicated by a reference numeral to avoid cluttering the drawing) arranged on a carrier 15*b*. The carriers 15*a-b* may, for example, be printed circuit boards, wire arrays or meshes.

Each of the reflectors 13*a*, 13*b* has a specularly reflective surface 20*a*, 20*b* facing the light sources 10*a*, 10*b* and is arranged to redirect light emitted from the light sources 10*a*, 10*b* towards the optically reflective side 14 of the sound-absorbing layer 11.

The light-transmissive layer 12 is schematically shown in FIG. 2 as a light-diffusing sheet, which may, for example, be made of a textile or paper. It should, however, be noted that the light-transmissive layer 12 may be configured to perform other or further functions than to diffuse the light emitted by the LEDs 21, 22. For example, the light-transmissive layer 12 may be a prism sheet for controlling the spatial distribution of the light output by the light-emitting acoustic panel 1. It may, for example, be desirable to avoid glare.

The optically reflective outer surface 18 of the duct 4 may, for example, be a specularly reflective surface made from a metal, which may, for example, be provided as an adhesive metal foil. Various ways of achieving a specular reflector are well known to those skilled in the relevant art.

Finally, the light-emitting acoustic panel 1 comprises a frame 28 for fixing the relative positions of the sound-absorbing layer 11, the light-transmissive layer 12 and the light sources 10*a-b*, and for holding the light-emitting acoustic panel 1 together. The frame 28 may, for example, be metallic or may be made of a suitable plastic material.

Figure 3:
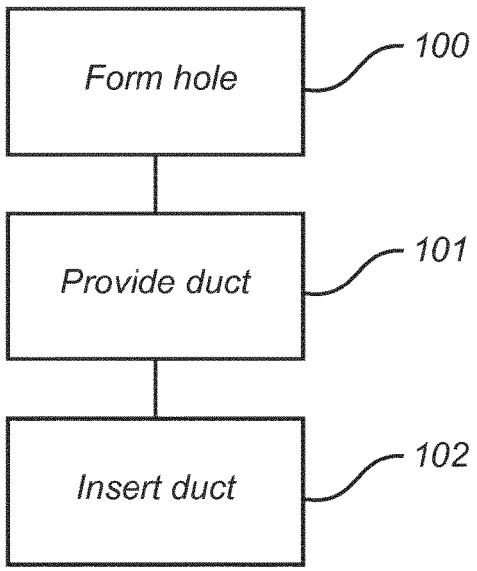
FIG. 3 is a flow chart for illustration of an exemplary method according to an embodiment of the invention.

Having now described an exemplary configuration of the light-emitting acoustic panel 1 according to an embodiment of the present invention, an exemplary method of providing a light-emitting acoustic panel 1 will now be described with reference to the flow-chart in FIG. 3 as well as to FIG. 1 and FIG. 2.

In a first step 100 a hole is formed through the light-emitting acoustic panel 1. The hole is a though-hole which means it allows a direct view through the light-emitting acoustic panel 1. The through-hole is aligned with a location of a functional component already installed in the ceiling, or with a location where a functional component will be installed, if the location coincides with a location of a light-emitting acoustic panel 1. A through-hole is made using any appropriate tool depending on the material of the light-emitting acoustic panel 1.

In a second step 101, a duct 4 with a reflective outer surface 18 is provided. It is made sure that the size of the through-hole is similar to the outer diameter of the duct 4. Naturally, the size of the though-hole and the duct is adapted to the size of the functional component to be arranged in the duct 4. The functional component may be a sprinkler 5 as shown in FIG. 1, or it may be a spotlight or a sensor such as a fire alarm or a motion sensor.

In a final step 102, the duct 4 is inserted into the hole of the light-emitting acoustic panel 1. The duct 4 may be connected to the rest of the light-emitting acoustic panel 1, for instance, through press-fit or by gluing, or through any other appropriate method.

Additionally, variations to the disclosed embodiments can be understood and effected by the skilled person in practicing the claimed invention, from a study of the drawings, the disclosure, and the appended claims. For example, the shape of the duct may be different from the described cylindrical shape. It may for example have a rectangular, or a hexagonal cross-section, or any other type of cross-section. The duct may furthermore extend in a non-straight/non-perpendicular manner from the sound-absorbing layer to the light-transmissive layer depending on the shape of the functional component to be incorporated in the acoustic panel. The materials of any reflective surfaces may be made from other materials than mentioned herein, that may fulfill the same purpose.

In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A light-emitting acoustic panel, comprising:
   - a light source;
   - a sound-absorbing layer having an optically reflective side facing the light source;
   - a light-transmissive layer arranged in parallel with and spaced apart from the sound-absorbing layer, such that the light source is arranged in a space between the sound-absorbing layer and the light-transmissive layer, and the light source is arranged on a carrier spaced apart from the light-transmissive layer by an inclined member; and
   - a duct through the light-emitting acoustic panel, wherein a surface of the duct facing the space between the sound-absorbing layer and the light-transmissive layer is a specularly reflective surface.

2. The light-emitting acoustic panel according to claim 1, wherein the surface of the duct, facing the space between the sound-absorbing layer and the light-transmissive layer, has a reflectance higher than 50%.

3. The light-emitting acoustic panel according to claim 1, wherein the duct extends through the sound-absorbing layer and the light-transmissive layer perpendicular to the sound-absorbing layer.

4. The light-emitting acoustic panel according to claim 1, further comprising a reflector arranged to receive light from the light source and to redirect the received light towards the optically reflective side of the sound-absorbing layer, wherein the light source is arranged offset from a focal point of the reflector.

5. The light-emitting acoustic panel according to claim 4, wherein a cross-section of the reflector in a plane perpendicular to the sound-absorbing layer comprises a parabolic line segment.

6. The light-emitting acoustic panel according to claim 1, wherein the light source comprises a plurality of lighting units arranged along an edge portion of the light-emitting acoustic panel.

7. The light-emitting acoustic panel according to claim 1, wherein the duct is cylindrical.

8. The light-emitting acoustic panel according to claim 1, wherein the light source comprises at least one solid state lighting unit.

9. The light-emitting acoustic panel according to claim 1, wherein the light-transmissive layer is an optically diffusive layer.

10. The light-emitting acoustic panel according to claim 1, wherein the light-transmissive layer is air permeable to allow acoustic pressure waves to reach the sound-absorbing layer.

11. A method of manufacturing a light-emitting acoustic panel according to claim 1, wherein the method comprises the steps of:

providing a light-emitting acoustic panel comprising a light source; a sound-absorbing layer having an optically reflective side facing the light source; and a light-transmissive layer arranged in parallel with and spaced apart from the sound-absorbing layer, the light source being arranged in a space between the sound-absorbing layer and the light-transmissive layer;

forming a hole through the light-emitting acoustic panel;

providing a duct having a specularly reflective outer surface; and inserting the duct in the hole through the light-emitting acoustic panel.

* * * * *